US007245868B2

(12) United States Patent
Arai

(10) Patent No.: US 7,245,868 B2
(45) Date of Patent: Jul. 17, 2007

(54) IMAGE FORMING APPARATUS AND METHOD OF MOUNTING AND DISMOUNTING A WASTE TONER BOTTLE

(75) Inventor: Yuji Arai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 83 days.

(21) Appl. No.: 11/128,253

(22) Filed: May 13, 2005

(65) Prior Publication Data

US 2005/0260019 A1 Nov. 24, 2005

(30) Foreign Application Priority Data

May 24, 2004 (JP) ..... 2004-152660

(51) Int. Cl.
*G03G 21/12* (2006.01)

(52) U.S. Cl. ..... 399/360

(58) Field of Classification Search ..... 399/123, 399/358, 360
See application file for complete search history.

(56) References Cited

U.S. PATENT DOCUMENTS 4,602,864 A * 7/1986 Kimura et al. ..... 399/123
5,398,098 A * 3/1995 Fukunaga et al. ..... 399/358 X

FOREIGN PATENT DOCUMENTS

JP 2003-36011 2/2003

* cited by examiner

*Primary Examiner*—Sandra L. Brase
(74) *Attorney, Agent, or Firm*—Oblon, Spivak, McClelland, Maier & Neustadt, P.C.

(57) ABSTRACT

An image forming apparatus of the present invention is operable with a waste toner bottle removably mounted thereto for collecting residual toner left on an image carrier after image formation. The image forming apparatus includes a handle to be held by an operator for holding the waste toner bottle, and a locking mechanism included in the handle for preventing the waste toner bottle from coming off the apparatus.

12 Claims, 8 Drawing Sheets

IMAGE FORMING APPARATUS AND METHOD OF MOUNTING AND DISMOUNTING A WASTE TONER BOTTLE

BACKGROUND OF THE INVENTION

1. Field of the Invention

The present invention relates to a copier, printer, facsimile apparatus, multifunction apparatus or similar electrophotographic image forming apparatus and more particularly to an image forming apparatus of the type including a process cartridge and a method of mounting or dismounting a waste toner bottle.

2. Description of the Background Art

Today, there is an increasing demand for toner with a small grain size or produced by polymerization that implements high image quality required of a printer, copier or similar image forming apparatus. Also, a current trend is toward an image forming apparatus of the type operable with a process cartridge removably mounted thereto. In this type of image forming apparatus, a waste toner bottle is removably mounted for collecting residual toner removed from a photoconductive element after image transfer. The problem with the waste toner bottle is that it is apt to come off the image forming apparatus and cause the toner to fly about or drop, smearing the operator of the apparatus or the apparatus itself.

In light of the above, Japanese Patent Laid-Open Publication No. 2003-36011, for example, discloses a mechanism in which a locking portion, included in a lever for releasing an intermediate image transfer belt, locks or unlocks a waste toner bottle to or from an apparatus body in interlocked relation to the contact or the release, respectively, of the belt. This mechanism, however, has a drawback that because the waste toner bottle is simply positioned in an unstable condition, it is apt to drop due to, e.g., an impact when the user unlocks the waste toner bottle by holding the lever and turning it in the unlocking direction. To solve this problem, it is necessary for the user to unlock the waste toner bottle while holding it.

SUMMARY OF THE INVENTION

It is an object of the present invention to prevent a waste toner bottle from easily coming off an image forming apparatus while promoting easy replacement of the bottle.

An image forming apparatus of the present invention is operable with a waste toner bottle removably mounted thereto for collecting residual toner left on an image carrier after image formation. The image forming apparatus includes a handle to be held by an operator for holding the waste toner bottle, and a locking mechanism included in the handle for preventing the waste toner bottle from coming off the apparatus.

Also, in a method of mounting or dismounting a waste toner bottle to or from an image forming apparatus of the present invention, an operator slides a locking member to a preselected locking position or a preselected unlocking position with a thumb while holding a handle included in said waste toner bottle with one hand to thereby mount or dismount, respectively, the waste toner bottle to or from the image forming apparatus.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
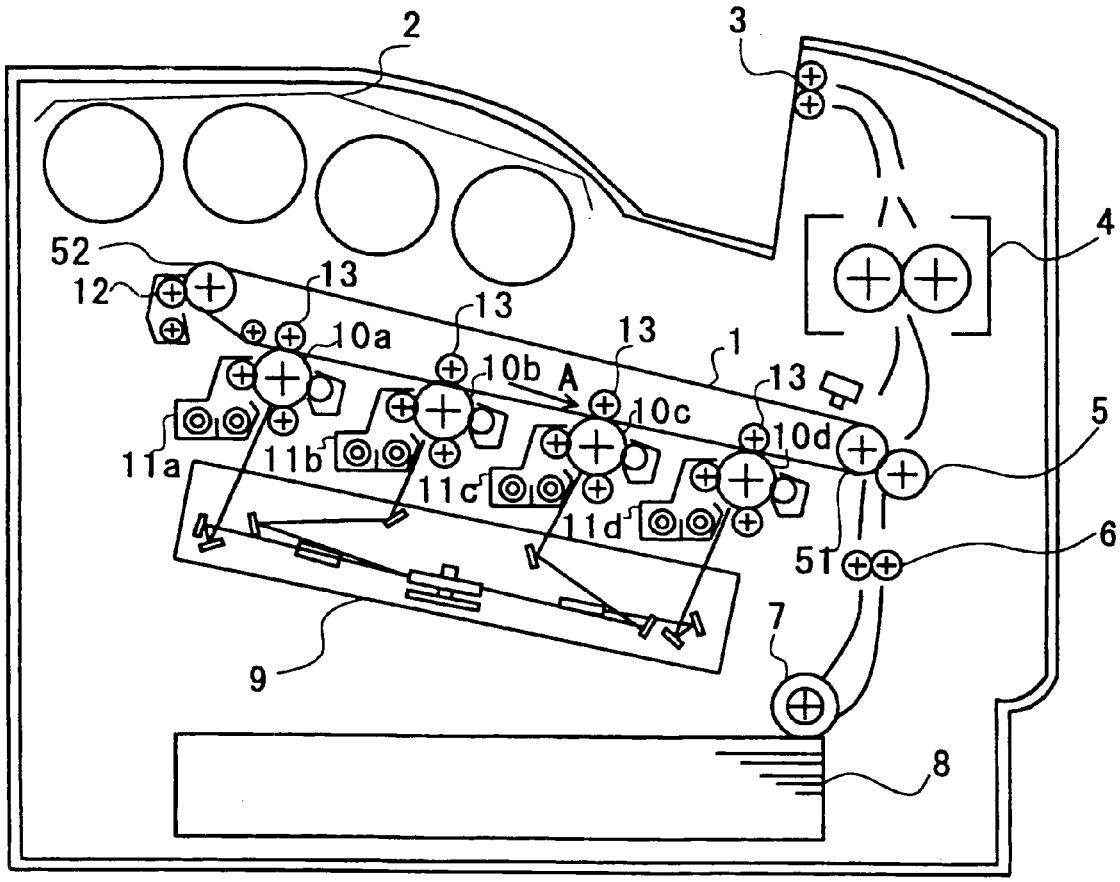
FIG. 1 shows the general construction of an image forming apparatus embodying the present invention.
Figure 2:
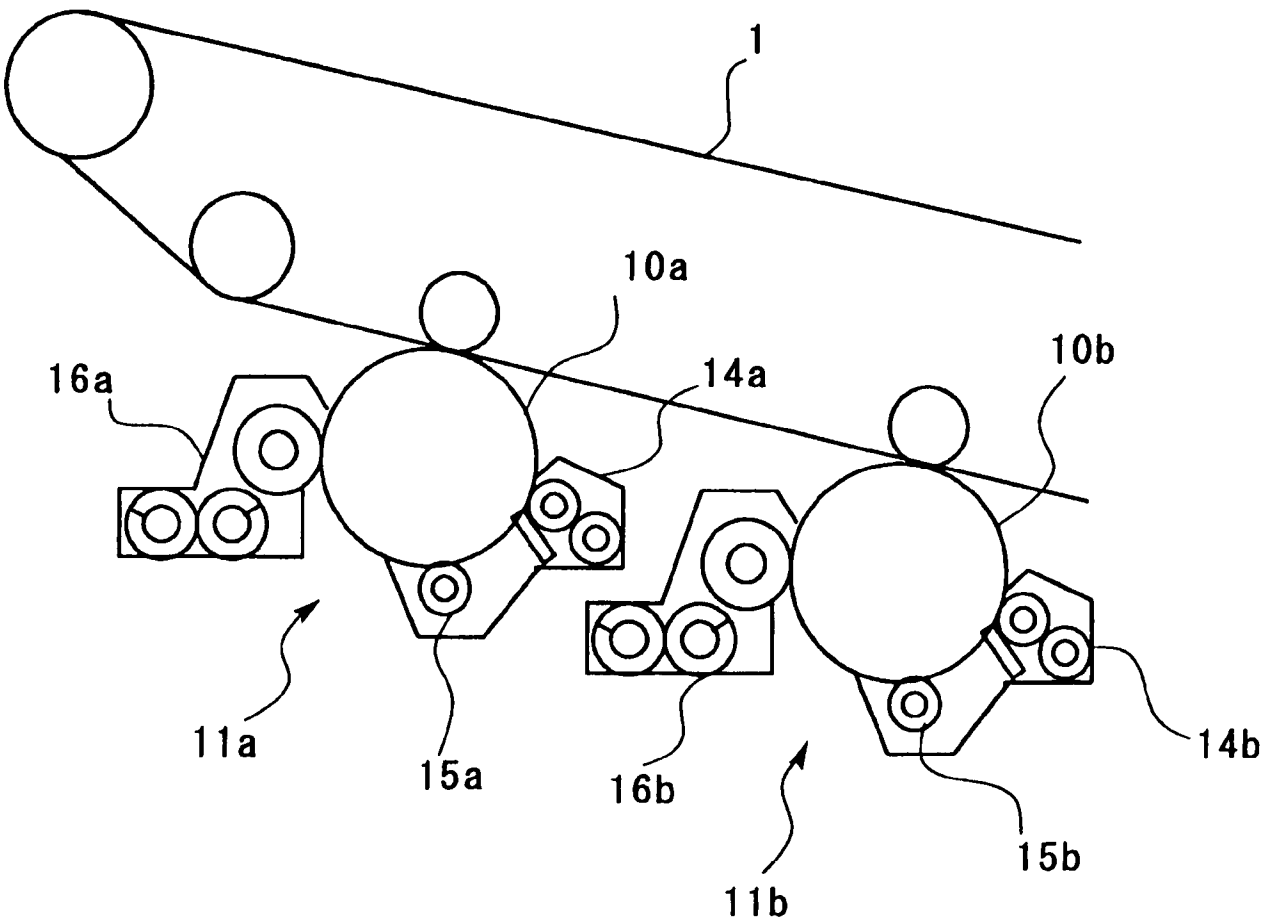
FIG. 2 is a fragmentary enlarged view showing major part of the illustrative embodiment.

Referring to FIG. 1 of the drawings, an image forming apparatus embodying the present invention is shown. FIG. 2 shows major part of the illustrative embodiment in a fragmentary enlarged view. As shown, an intermediate image transfer belt (simply belt hereinafter) 1 is positioned at substantially the center of the inside of the apparatus. The belt 1, implemented as an endless belt, includes a base member formed of polyimide, polyamide or similar heat-resistant material and provided with medium resistance. The belt 1 is passed over a plurality of rollers and caused to turn in a direction indicated by an arrow A in FIG. 1.

Four process cartridges 11*a*, 11*b*, 11*c* and 11*d* are positioned side by side along the lower run of the belt 1 and respectively include photoconductive drums 10*a*, 10*b*, 10*c* and 10*d* that contact the lower run or the belt 1. It is to be noted that the photo conductive drums (simply drums hereinafter) 10*a* through 10*d* each are a specific form of an image carrier. As can be seen in FIG. 2. arranged around the drums 10*a* and 10*b* are charge rollers 15*a* and 15*b* and cleaning units 14*a* and 14*b*, respectively. Developing units 16*a* and 16*b* are positioned in correspondence to the process cartridges 11*a* and 11*b* respectively, and are identical in configuration with each other except for the color of toner to use. Though not pictured in FIG. 2. charge rollers and cleaning units are also arranged around drums 10*c* and 10*d* in an identical configuration to that described above with respect to 10*a* and 10*b*. Also not pictured in FIG. 2, developing units are positioned in correspondence to the process cartridges 11*c* and 11*d*, and are identical in configuration with each other except for the color of toner to use.

The process cartridges 11*a* through 11*d* are identical in configuration with each other, but form a black toner image, a yellow toner image, a cyan toner image and a magenta toner image, respectively.

An optical writing unit 9 is located below the process cartridges 11*a* through 11*d* and includes four LDs (Laser Diodes) or light sources each being assigned to a particular color. The optical writing unit 9 further includes a polygonal scanner made up of a six-face polygonal mirror and a polygon motor, f-θ lenses each being positioned on the optical path of a particular LD, elongate cylindrical lenses or similar lenses and mirrors. A laser beam emitted from any one of the LDs is deflected by the polygonal scanner and then incident on associated one of the drums 10*a* through 10*d*.

Image transfer rollers 13 respectively face the drums 10*a* through 10*d* with the intermediary of the belt 1 in order to transfer toner images formed on the drums 10*a* through 10*d* to the belt 1. This image transfer will be referred to as primary image transfer. The image transfer rollers 13 are connected to a power supply, not shown, to be applied with a preselected voltage therefrom.

A secondary image transfer roller 5 is pressed against the outside of part of the belt 1 supported by a roller 51 and is connected to a power supply, not shown, to be applied with a preselected voltage therefrom. The position where the secondary image transfer roller 5 and belt 1 contact each other constitutes a secondary image transfer zone for transferring a composite toner image from the belt 1 to a paper sheet or similar recording medium. A belt cleaning unit 12 faces the outside surface of the portion of the belt 1 supported by a roller 52 in order to clean the outside surface of the belt 1 after secondary image transfer.

A fixing unit 4 is positioned above the secondary image transfer zone for permanently fixing the composite toner image transferred from the belt 1 to the paper sheet. A paper feeding unit 8 is positioned in the lower portion of the apparatus and loaded with a stack of paper sheets. The sheets are fed from the paper feeding unit 8 toward the secondary image transfer zone one by one.

The operation of the illustrative embodiment will be described hereinafter. Toner bottles 2 respectively store yellow toner, cyan toner, magenta toner and black toner, as named from the left to the right in FIG. 1. Each toner is replenished from a particular toner bottle 2 to preselected one of the developing units 16*a* through 16*d* via a path, not shown, in a preselected amount.

When the apparatus is caused to start operating, the drums 10*a* through 10*d* rotate clockwise, as viewed in FIG. 1, while the charge rollers arranged around the drums uniformly charge the surfaces of the drums, respectively. The optical writing unit 9 scans the surfaces of the drums 10*a* through 10*d* thus scanned with laser beams in accordance with respective image data, thereby forming latent images of respective colors on the drums 10*a* through 10*d*. Subsequently, the developing units develop the latent images formed on the drums 10*a* through 10*b* with magenta toner, cyan toner, yellow toner and black toner, thereby producing toner images of four different colors.

On the other hand, a pickup roller 7, included in the paper feeding unit 8, pays out the top paper sheet toward a registration roller pair 6. The registration roller pair 6 stops the paper sheet and then drives it toward the secondary image transfer zone between the secondary image transfer roller 5 and the belt 1 in accordance with the output of a sensor, not shown, responsive to the leading edge of the paper sheet.

Subsequently, voltages are applied to the image transfer rollers 13 so as to sequentially transfer the toner images of different colors from the drums 10*a* through 10*d* to the belt 1 one above the other. At this instant, the image forming operation is shifted in timing from the upstream side to the downstream side such that the toner images are transferred to the same position of the belt 1 one above the other, thereby completing a full-color toner image on the belt 1. When the four-color toner image is conveyed to the secondary image transfer zone by the belt 1, it is transferred from the belt 1 to the paper sheet by the secondary image transfer roller 5. The paper sheet, carrying the full-color toner image thereon, is then conveyed to the fixing unit 4. The fixing unit 4 fixes the toner image on the paper sheet with heat and pressure. The paper sheet or print, coming out of the fixing unit 4, is driven out of the apparatus by an outlet roller pair 3.

Toners left on the drums 10*a* through 10*d* after the primary image transfer are removed by the cleaning units arranged around the drums. Likewise, toner left on the belt 1 after the secondary image transfer is removed by the belt cleaning unit 12.

Figure 3:
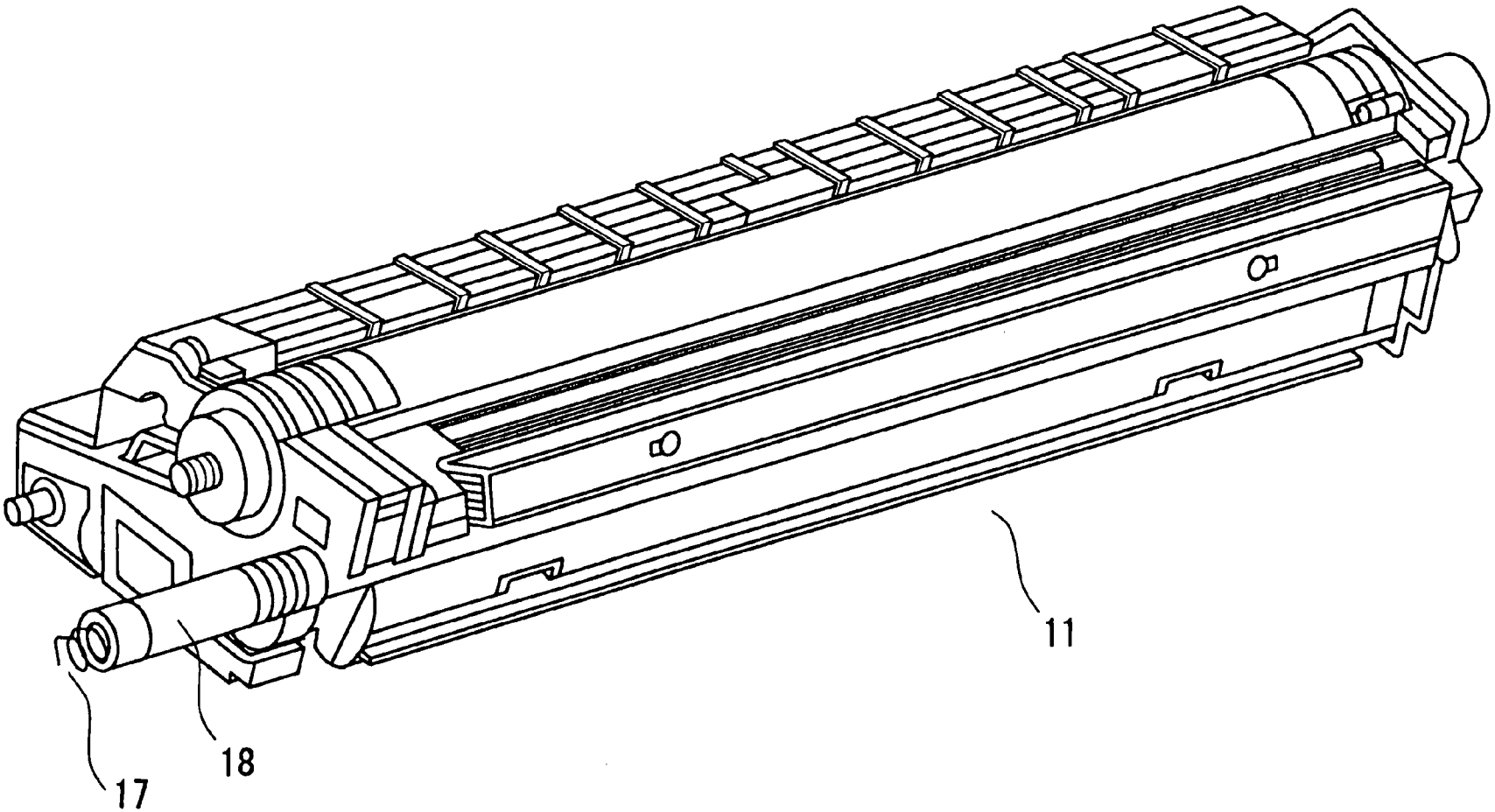
FIG. 3 is a view showing one of process cartridges included in the illustrative embodiment.
Figure 4:
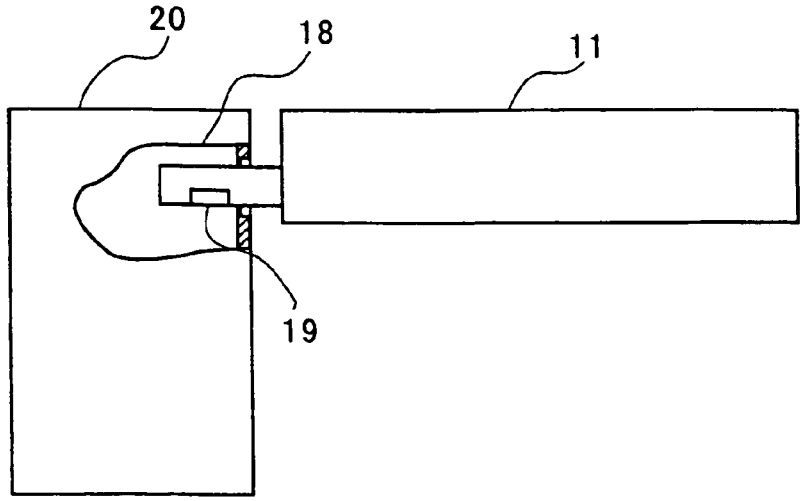
FIG. 4 shows the process cartridge and a waste toner bottle included in the illustrative embodiment.

FIG. 3 shows one of the process cartridges 11*a* through 11*d* while FIG. 4 shows the process cartridge together with a waste toner bottle also included in the illustrative embodiment. As shown, a coil 17, disposed in each cleaning unit arranged around the drums, conveys the waste toner removed from each of the drums 10*a*, 10*b*, 10*c*, and 10*d*. respectively, to a waste toner bottle 20 mounted on the apparatus via a waste toner outlet 19, which is formed in a waste toner pipe 18 included in the process cartridge 11. If desired, the waste toner may be conveyed to a waste toner bottle via a waste toner path formed in the apparatus instead of being directly delivered to the waste toner bottle 20, although not shown specifically.

Figure 5:
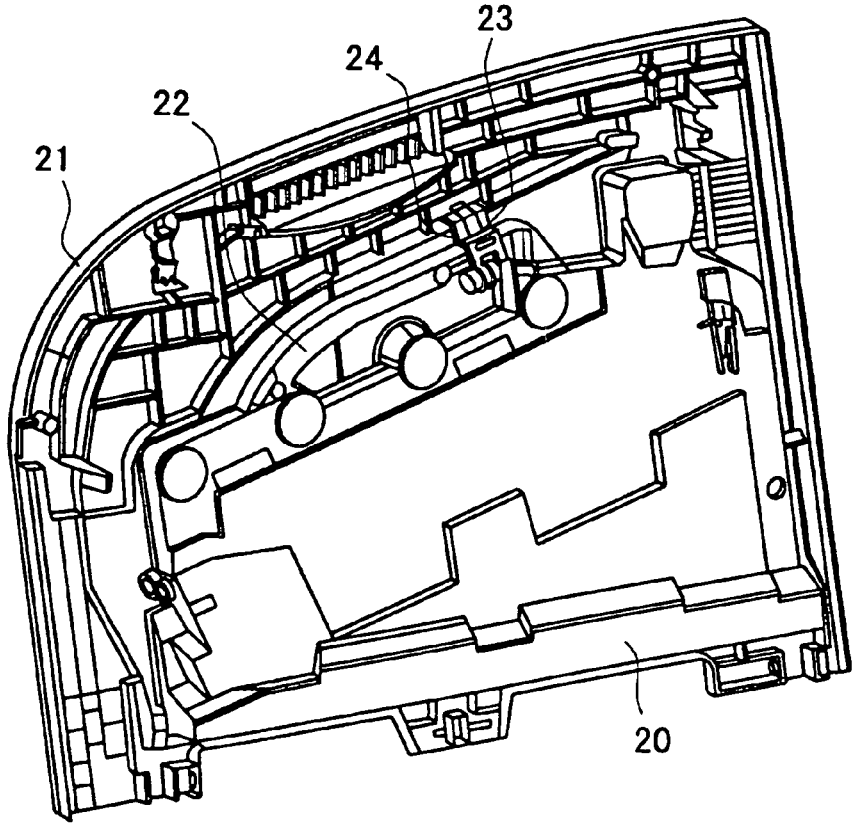
FIG. 5 shows arrangements around the waste toner bottle of the illustrative embodiment.

FIG. 5 shows arrangements around the waste toner bottle 20 mounted to the apparatus. As shown, the waste toner bottle 20 is mounted to an openable cover 21 included in the apparatus and is mounted to or dismounted from the apparatus by opening the cover 21. The waste toner bottle 20 includes a handle 22 provided with a slide type locking member 23 while the cover 21 includes a slide type hook member 24. When the locking member 23 is engaged with the hook member 24, the waste toner bottle 20 is prevented from dropping from the cover 21. This kind of arrangement is usable even when the waste toner bottle 20 is not mounted to the cover 21, but is mounted to the apparatus.

Figure 6A:
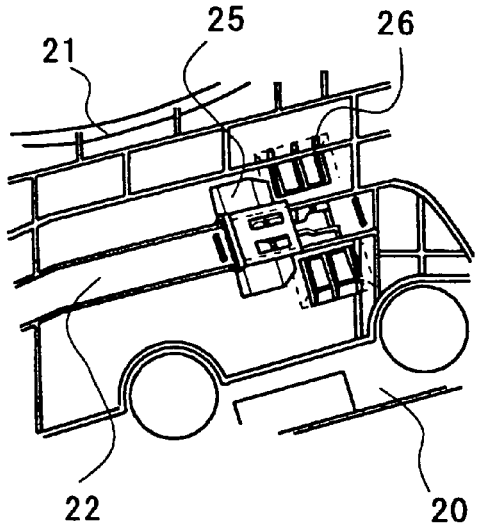
FIGS. 6A through 6C show a slide type locking mechanism included in the illustrative embodiment for locking or unlocking the waste toner bottle.
Figure 6B:
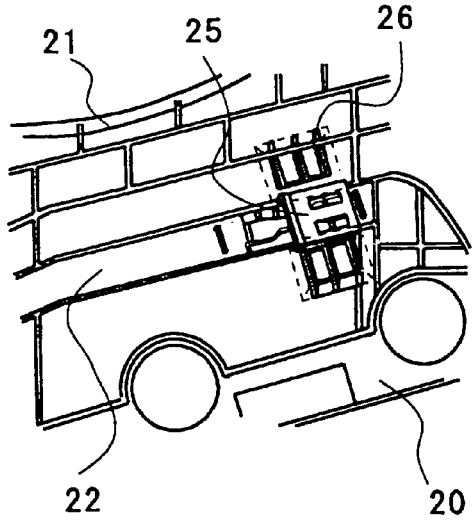
Figure 6C:
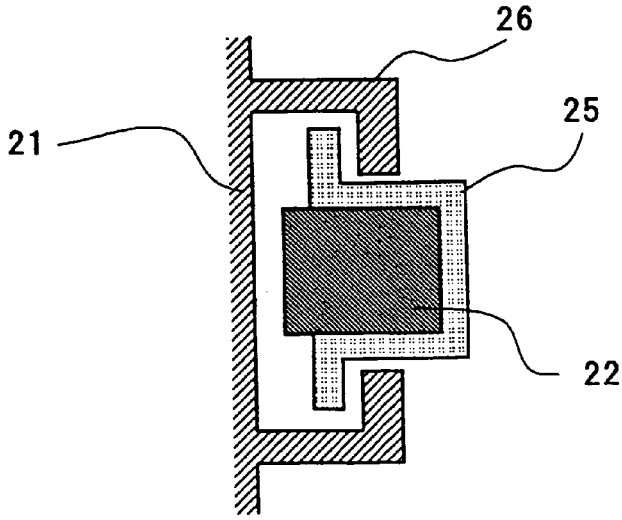

FIGS. 6A through 6C show a slide type locking mechanism included in the illustrative embodiment. More specifically, FIG. 6A and 6B show an unlocked condition and a locked condition, respectively. As shown in FIG. 6C in a section, when the slidable locking member 23 is engaged with the hook member 24 of the cover 21, the waste toner bottle 20 is prevented from dropping from the cover 21.

Figure 7A:
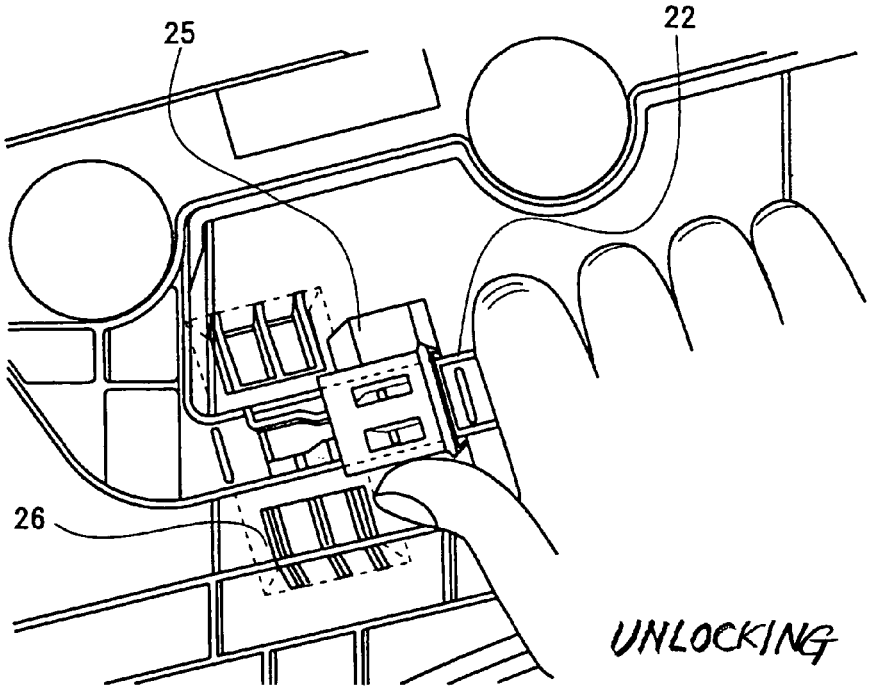
FIGS. 7A and 7B demonstrate the operation of the slide type locking mechanism.
Figure 7B:
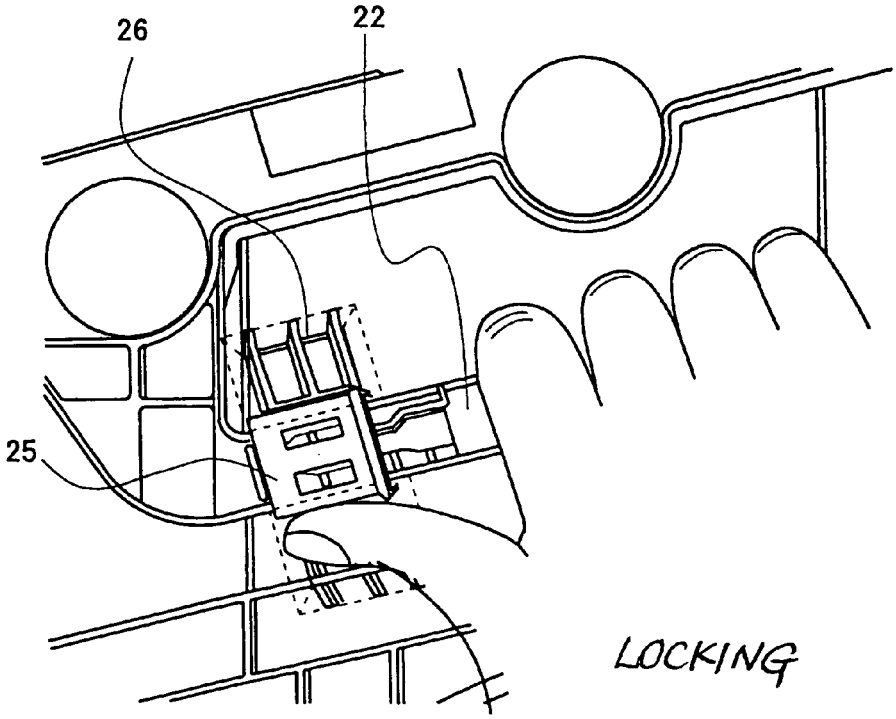

FIGS. 7A and 7B respectively correspond to FIGS. 6A and 6B that show the locked condition and unlocked condition of the slide type locking mechanism. As shown, an operator is capable of mounting or dismounting the waste toner bottle 20 by holding the handle 22 that includes the locking mechanism, and therefore capable of easily replacing the bottle 20 with one hand.

Figure 8A:
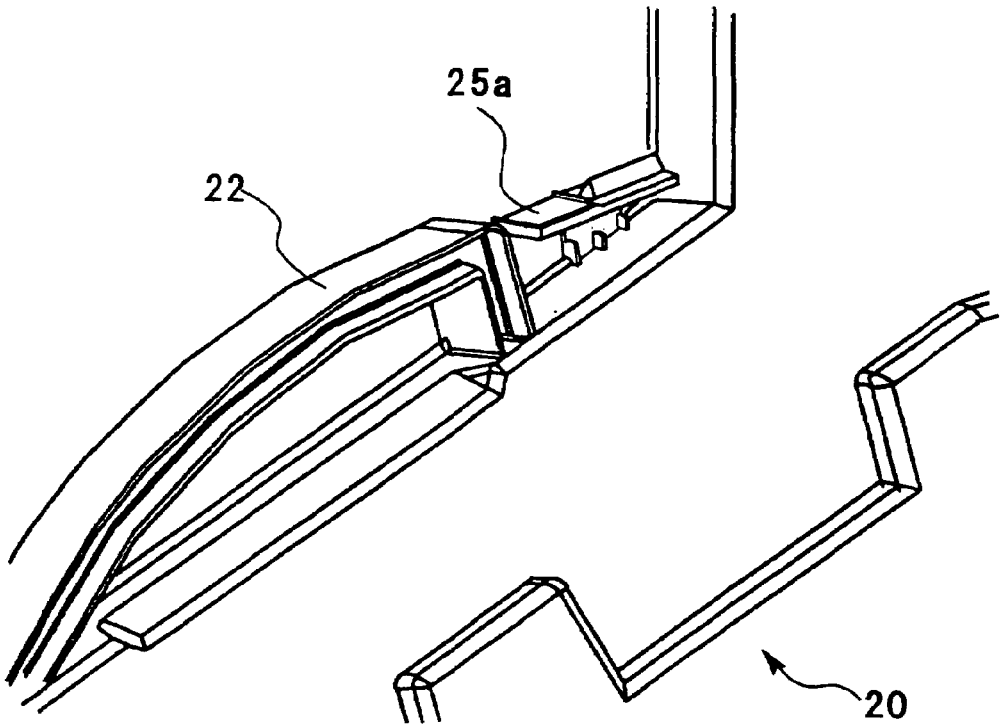
FIGS. 8A through 8C show a push type locking mechanism replaceable with the slide type locking mechanism.
Figure 8B:
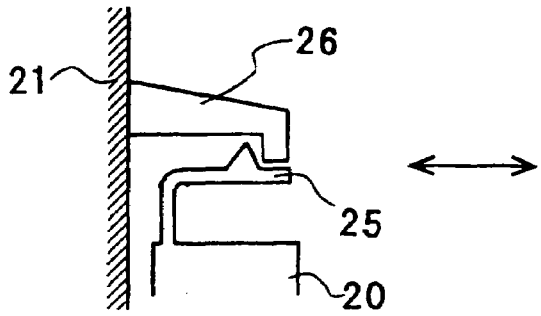
Figure 8C:
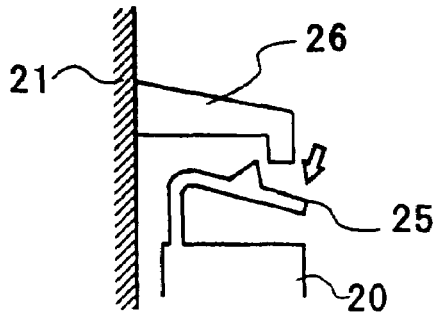

FIGS. 8A through 8C show an alternative locking mechanism in accordance with the present invention. More specifically, FIG. 8A shows members arranged around the handle 22 of the waste toner bottle 20 while FIGS. 8B and 8C show an unlocked condition and a locked condition, respectively. As shown in FIGS. 8A-8C, when the operator pushes a press portion 25*a* included in a push type locking member or thumb piece 25, the push portion 25*a* bends a lever with the result that the locking member 25 is released from a cover hook member 26.

Figure 9:
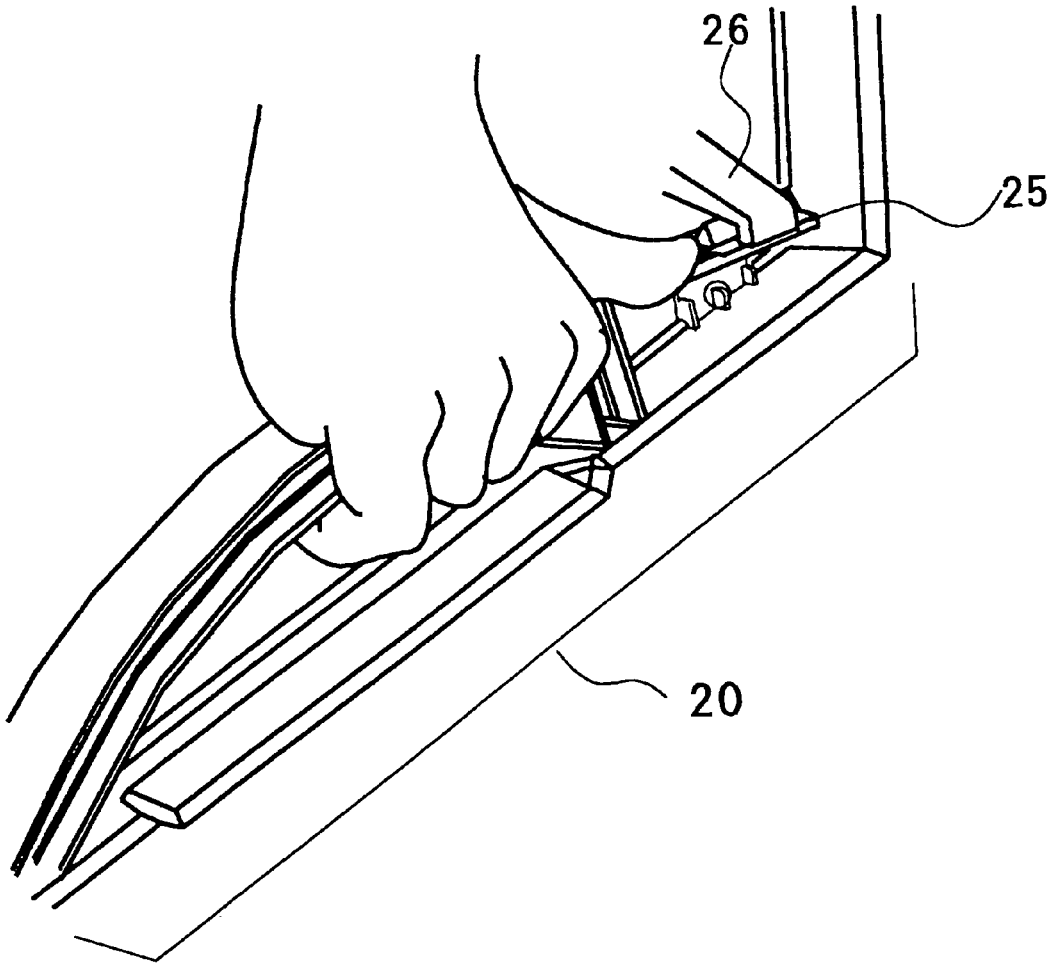
FIG. 9 demonstrates the operation of the push type locking mechanism.

FIG. 9 shows the operation of the push type locking mechanism of FIGS. 8A through 8C. As shown, by pushing the push portion 25*a* while holding the handle 22, the operator is capable of mounting or dismounting the waste toner bottle 20 with one hand and therefore as easily as with the slide type locking mechanism.

In summary, in accordance with the present invention, a waste toner bottle mounted to an image forming apparatus is prevented from coming off and can be easily mounted to or dismounted from the apparatus by one hand.

Various modifications will become possible for those skilled in the art after receiving the teachings of the present disclosure without departing from the scope thereof.

What is claimed is:

1. An image forming apparatus with a waste toner bottle removably mounted thereto for collecting a residual toner left on an image carrier after image formation, said image forming apparatus comprising:

a handle formed from a closed loop and configured to be held by an operator for holding the waste toner bottle; and a locking mechanism included in said handle configured to prevent the waste toner bottle from coming off said image forming apparatus, wherein said locking mechanism is of a slide type.

2. The apparatus as claimed in claim 1, further comprising a process cartridge including the waste toner bottle.

3. An image forming apparatus with a waste toner bottle removably mounted thereto for collecting a residual toner left on an image carrier after image formation, wherein the waste toner bottle includes a handle formed from a closed loop, wherein the waste toner bottle includes a locking mechanism movably mounted thereon, and wherein the image forming apparatus includes a fixed hook configured to engage the locking mechanism, and wherein said locking mechanism is of a slide type.

4. The apparatus as claimed in claim 3, further comprising a process cartridge including the waste toner bottle.

5. In a method of mounting or dismounting a waste toner bottle to or from an image forming apparatus, an operator slides a locking member to a preselected locking position or a preselected unlocking position with a thumb while holding a handle included in said waste toner bottle with one hand to thereby mount or dismount, respectively, said waste toner bottle to or from said image forming apparatus.

6. In a method of mounting or dismounting a waste toner bottle to or from an image forming apparatus, an operator slides an elastic locking member to a preselected locking position or a preselected unlocking position with a thumb while holding a handle included in said waste toner bottle with one hand to thereby mount or dismount, respectively, said waste toner bottle to or from said image forming apparatus.

7. An image forming apparatus with a waste toner bottle removably mounted thereto for collecting a residual toner left on an image carrier after image formation, said image forming apparatus comprising:

a means for holding and supporting with a single hand the waste toner bottle during a removal of the waste toner bottle from said image forming apparatus by an operator; and a means for preventing the waste toner bottle from detaching from said image forming apparatus, wherein the means for preventing the waste toner bottle from detaching is positioned to enable the operator to disengage the means for preventing the waste toner bottle from detaching with the single hand while holding the means for holding and supporting with the single hand.

8. The image forming apparatus as claimed in claim 7, wherein the means for preventing the waste toner bottle from detaching includes a sliding mechamsm.

9. The image forming apparatus as claimed in claim 7, wherein the means for preventing the waste toner bottle from detaching includes a pushing mechanism.

10. The image forming apparatus as claimed in claim 7, further comprising a process cartridge including the waste toner bottle.

11. An image forming apparatus with a waste toner bottle removably mounted thereto for collecting a residual toner left on an image carrier after image formation, said image forming apparatus comprising:

a handle to be held by an operator for holding the waste toner bottle; and a locking mechanism included in said handle for preventing the waste toner bottle from coming off said image forming apparatus, wherein said locking mechanism is of a slide type.

12. An image forming apparatus with a waste toner bottle removably mounted thereto for collecting a residual toner left on an image carrier after image formation, said image forming apparatus comprising:

a handle to be held by an operator for holding the waste toner bottle; and a locking mechanism positioned in the vicinity of said handle for preventing the waste toner bottle from coming off said image forming apparatus, wherein said locking mechanism is of a slide type.

* * * * *